US007770662B2

(12) United States Patent
Harvey et al.

(10) Patent No.: US 7,770,662 B2
(45) Date of Patent: Aug. 10, 2010

(54) BALLISTIC SYSTEMS HAVING AN IMPEDANCE BARRIER

(75) Inventors: William Harvey, Houston, TX (US); Meir Mayseless, Haifa (IL); Anna Schwartz, Raanana (IL); Timothy Sampson, Spring, TX (US); Mark Sloan, Bellville, TX (US); Jason McCann, Cypress, TX (US); Avigdor Hetz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 171 days.

(21) Appl. No.: 11/485,909

(22) Filed: Jul. 13, 2006

(65) Prior Publication Data

US 2007/0095572 A1 May 3, 2007

Related U.S. Application Data

(60) Provisional application No. 60/730,671, filed on Oct. 27, 2005.

(51) Int. Cl.
*E21B 7/00* (2006.01)
*E21B 43/116* (2006.01)

(52) U.S. Cl. ..... 175/4.6; 175/4.56; 166/63

(58) Field of Classification Search ..... 175/4.6; 102/306–310; 89/1.15, 1.151
See application file for complete search history.

(56) References Cited

U.S. PATENT DOCUMENTS

| | | | | |
|---|---|---|---|---|
| 1,300,333 | A * | 4/1919 | Berry | 102/383 |
| 2,686,472 | A * | 8/1954 | Burns | 175/4.6 |
| 2,782,715 | A | 2/1957 | Udry | |
| 3,094,930 | A * | 6/1963 | Blair | 175/4.6 |
| 4,191,265 | A * | 3/1980 | Bosse-Platiere | 175/4.56 |
| 4,794,990 | A | 1/1989 | Riggs | |
| 4,817,531 | A | 4/1989 | Walker et al. | |
| 5,619,008 | A * | 4/1997 | Chawla et al. | 102/310 |
| 5,837,925 | A * | 11/1998 | Nice | 102/310 |
| 5,841,060 | A | 11/1998 | Skaggs | |
| 6,386,109 | B1 | 5/2002 | Brooks et al. | |
| 6,412,415 | B1 * | 7/2002 | Kothari et al. | 102/313 |
| 6,520,258 | B1 * | 2/2003 | Yang et al. | 166/297 |
| 6,941,871 | B2 * | 9/2005 | Mauldin | 102/323 |
| 2003/0150646 | A1 * | 8/2003 | Brooks et al. | 175/2 |
| 2004/0104029 | A1 * | 6/2004 | Martin | 166/298 |
| 2004/0107825 | A1 * | 6/2004 | Kash | 89/1.15 |
| 2004/0216633 | A1 * | 11/2004 | Kash | 102/320 |
| 2005/0173118 | A1 | 8/2005 | Li et al. | |
| 2006/0048664 | A1 * | 3/2006 | Tiernan et al. | 102/332 |
| 2007/0119327 | A1 * | 5/2007 | Myers et al. | 102/306 |

* cited by examiner

*Primary Examiner*—David J Bagnell
*Assistant Examiner*—Cathleen R Hutchins
(74) *Attorney, Agent, or Firm*—Bracewell & Giuliani LLP

(57) ABSTRACT

A shaped charge assembly for use in a perforating gun that comprises a shaped charge holder, two or more shaped charges, slots formed to receive the shaped charges, and an impedance barrier disposed between adjacent shaped charges. The impedance barrier can comprise a gap formed in the shaped charge holder, where the impedance barrier runs across the shaped charge holder. The impedance barrier can be a void formed on the surface of the shaped charge holder, or can include shock attenuating material therein, such as wood, cork, cotton, polymeric materials, and combinations thereof, to name a few.

18 Claims, 3 Drawing Sheets

BALLISTIC SYSTEMS HAVING AN IMPEDANCE BARRIER

RELATED APPLICATIONS

This application claims priority from co-pending U.S. Provisional Application No. 60/730,671, filed Oct. 27, 2005, the full disclosure of which is hereby incorporated by reference herein.

BACKGROUND OF THE INVENTION

1. Field of the Invention

The invention relates generally to the field of oil and gas production. More specifically, the present invention relates to a ballistic system including an impedance barrier. Yet more specifically, the present invention relates to a perforating gun system whose shaped charges are held in a medium, and where a gap is formed within the medium between each adjacent shaped charge.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems 40 typically comprise one or more perforating guns 42 strung together, these strings of guns 42 can sometimes surpass a thousand feet of perforating length. Included with the perforating guns are shaped charges 44 that typically include a housing, a liner, an initiator, and a quantity of high explosive inserted between the liner and the housing. A detonating cord 46 attached to each shaped charge sequentially actuates the initiator within each shaped charge. The perforating systems are generally lowered into a wellbore on wireline or tubing 48 where the initiation of the perforating gun detonation is transmitted through the wireline or tubing 48. Firing heads 50 are typically included on the perforating guns for receiving the transmitted detonation signal from the surface 52 and in turn igniting the detonation cord 46.

When the high explosive within the shaped charge 44 is detonated, the force of the detonation collapses the liner and ejects it from one end of the charge at very high velocity in a pattern called a "jet" 54. The jet penetrates the casing, the cement and a quantity of the formation 56 thereby forming a conduit 58 by which the hydrocarbons entrained within the formation may be drained into the wellbore for production at the wellbore surface.

In addition to the perforating jet formed by detonation of the shaped charges, the charges also produce shock waves that emanate into the formation and along the perforating gun 42. These shock waves can be transmitted onto other shaped charges prior to or during their detonation and interfere with the trajectory of the perforating jet 54. This jet interference can in turn create curved perforations and reduce the overall depth of the perforations 58. Curved and shorter perforations present an undesired condition since this can reduce the production capability of hydrocarbon bearing formations. Therefore, there exists a need for an apparatus and method capable of impeding the shock and/or vibration transmitted between shaped charges.

BRIEF SUMMARY OF THE INVENTION

The present invention involves a shaped charge assembly comprising, a shaped charge holder, bores formed on the shaped charge holder, and an impedance barrier disposed between each bore formed in the shaped charge holder. The shaped charge holder may be a perforating gun tube, a perforating gun body, and a shaped charge carrier. The impedance barrier can be comprised of a void formed in the shaped charge holder. Moreover, an impedance material can be disposed in the void where the impedance material might consist of wood, cork, rubber, cotton, plastic, polymeric materials, wool, foam, other shock absorbing materials, and combinations thereof. The void may comprise a groove formed along the outer surface of the shaped charge holder. The impedance barrier may optionally comprise a series of rings axially disposed along the length of the shaped charge holder. The impedance barrier might instead be comprised of a spiral pattern interconnected with axial grooves or alternatively might comprise a spiral pattern formed on the shaped charge holder. Shaped charges can also be disposed within the bores of the shaped charge assembly.

Also included with the shaped charge assembly can be a firing head, a detonating cord, and an actuating member. The actuating member could be a wireline conveyance member or a tubing conveyed member.

An alternative embodiment of a shaped charge assembly is included with this invention. The alternative embodiment comprises a shaped charge holder, bores formed on the shaped charge holder, shaped charges disposed in each bore, and an impedance barrier formed between each bore formed in the shaped charge holder. The impedance barrier of this alternative embodiment attenuates the shock wave imparted during detonation of each shaped charge and prevents the shock wave produced by one shaped charge from affecting the performance of other shaped charges. The shaped charge holder can be a perforating gun tube, a perforating gun body, or a shaped charge carrier. The impedance barrier of the alternative embodiment can be comprised of a void formed in the shaped charge holder. Also in the alternative embodiment, an impedance material can be disposed in the void. The impedance material can be wood, cork, rubber, cotton, plastic, polymeric materials, wool, foam, other shock absorbing materials, and combinations thereof. The void can comprise a groove formed along the outer surface of the shaped charge holder. The impedance barrier of the alternative embodiment may comprise a spiral pattern formed on shaped charge holder. The alternative shaped charge assembly can further comprise shaped charges disposed within the bores. This embodiment of a shaped charge assembly can further comprise a firing head, detonating cord, and an actuating member. The actuating member can be a wireline conveyance member or a tubing conveyed member.

DETAILED DESCRIPTION OF THE INVENTION

The present device disclosed herein addresses the problem of shock wave interference in ballistics systems by providing an impedance barrier between the shock producing sources. FIG. 1*a* demonstrates an embodiment of a shaped charge assembly having an impedance barrier as disclosed herein. The shaped charge assembly 5 of FIG. 1*a* comprises a shaped charge holder 12 with bores 8 formed thereon with an impedance barrier 10 positioned between the bores 8. The shaped charge holder 12 can be any device used to hold and retain shaped charges, such as a gun body, gun tube, or any other type of carrier used for carrying and holding shaped charges. The shaped charge holder 12 may alternatively be a unibody type, such as a single piece or single body. The bores 8 on the shaped charge holder 12 should be formed to receive and hold therein the perforating shaped charges. Accordingly, when fully assembled, the shaped charge assembly would further include shaped charges within the bores 8 and the presence of the impedance barrier would isolate these shaped charges from the shock waves produced by other shaped charges. Moreover, the impedance barrier as disclosed herein is capable of isolating shaped charges from other transient shock waves that might be transmitted along a perforating gun system.

As shown in the embodiment of FIG. 1*a*, the bores 8 are generally aligned along the length of the shaped charge holder 12. Thus to provide an isolating function between the bores 8, the impedance barrier 10 is situated between each of the bores 8 in a series of rings formed along the length of the shaped charge holder 12. However the pattern of the impedance barrier 10 is not limited to the annular form of FIG. 1*a*, but can include any configuration necessary for isolating shaped charges from the shock of other shaped charges. The shaped charge holder 12*c* of FIG. 1*d* also has bores 8 aligned along its length, however the corresponding impedance barrier 10*c* has a spiral or helical formation along the outer surface of the charge holder 12*c*.

Figure 1C:
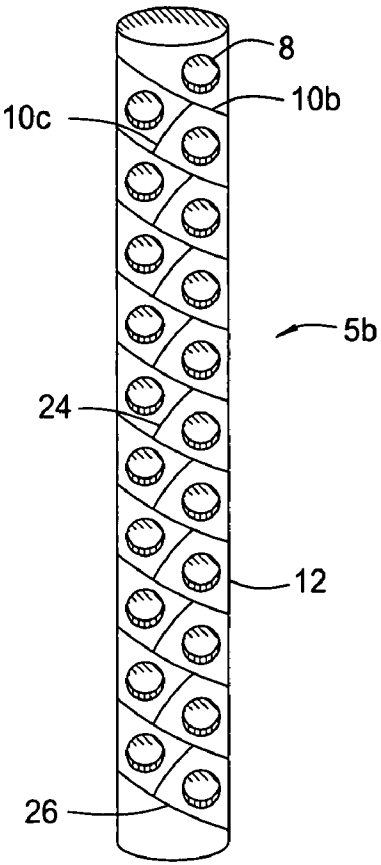
FIGS. 1*a*-1*d* depict a side view of embodiments of the present invention.
Figure 1A:
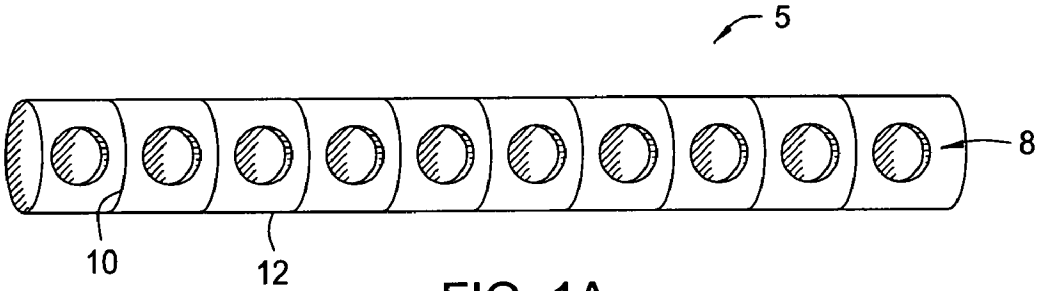
Figure 1B:
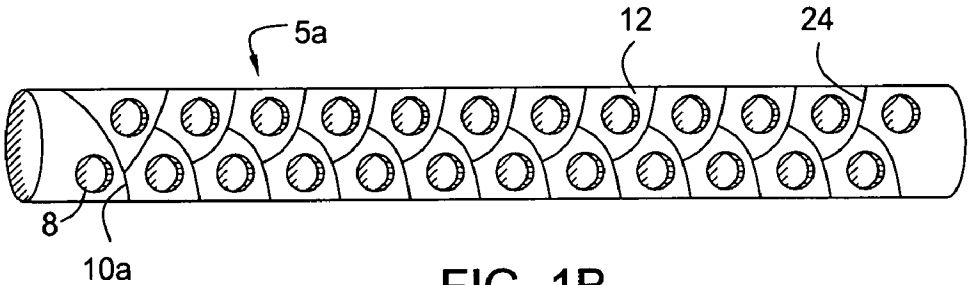
Figure 1D:
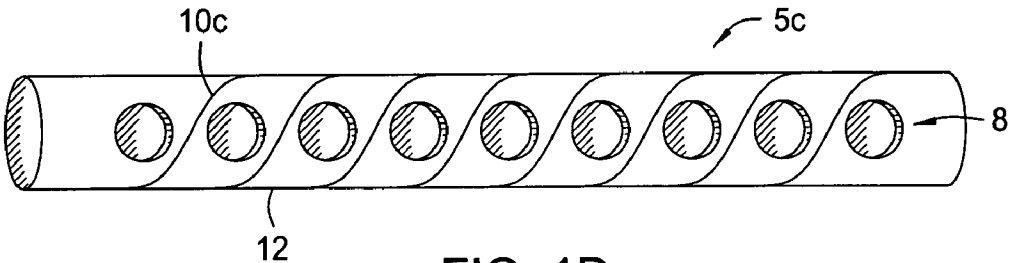

Alternative embodiments illustrating other impedance barrier configurations are shown in FIGS. 1*b* and 1*c*. In FIG. 1*b* a shaped charge holder 12 is shown where the bores 8 are disposed in a staggered arrangement along the length of the shaped charge holder 12. The resulting shape of the impedance barrier 10*a* is a series of interlocking grooves for isolating adjacent shaped charges from one another. Similarly, the shaped charge carrier 12 of FIG. 1*c* also includes a staggered bore pattern, here however the shaped of the impedance barrier 10*c* has the form of a helical 26 that spirals along the length of the shaped charge holder 12. Interconnecting verticals 24 axially connect the helical 26 to form a lateral barrier between bores 8 that are disposed at roughly the same axial location on the shaped charge holder 10*b* but that are radially spaced apart.

Figure 2:
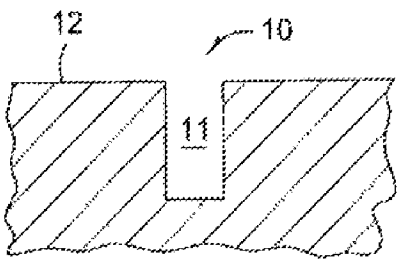
FIG. 2 illustrates a cut-away view of one embodiment of the present invention.
Figure 2A:
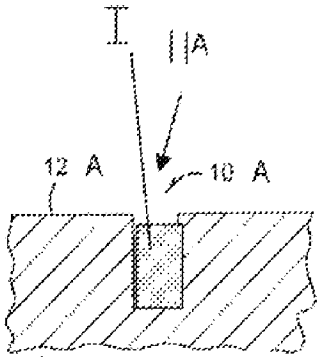
FIG. 2A illustrates a cut-away view of an alternate embodiment of a shaped charge holder.
Figure 4:
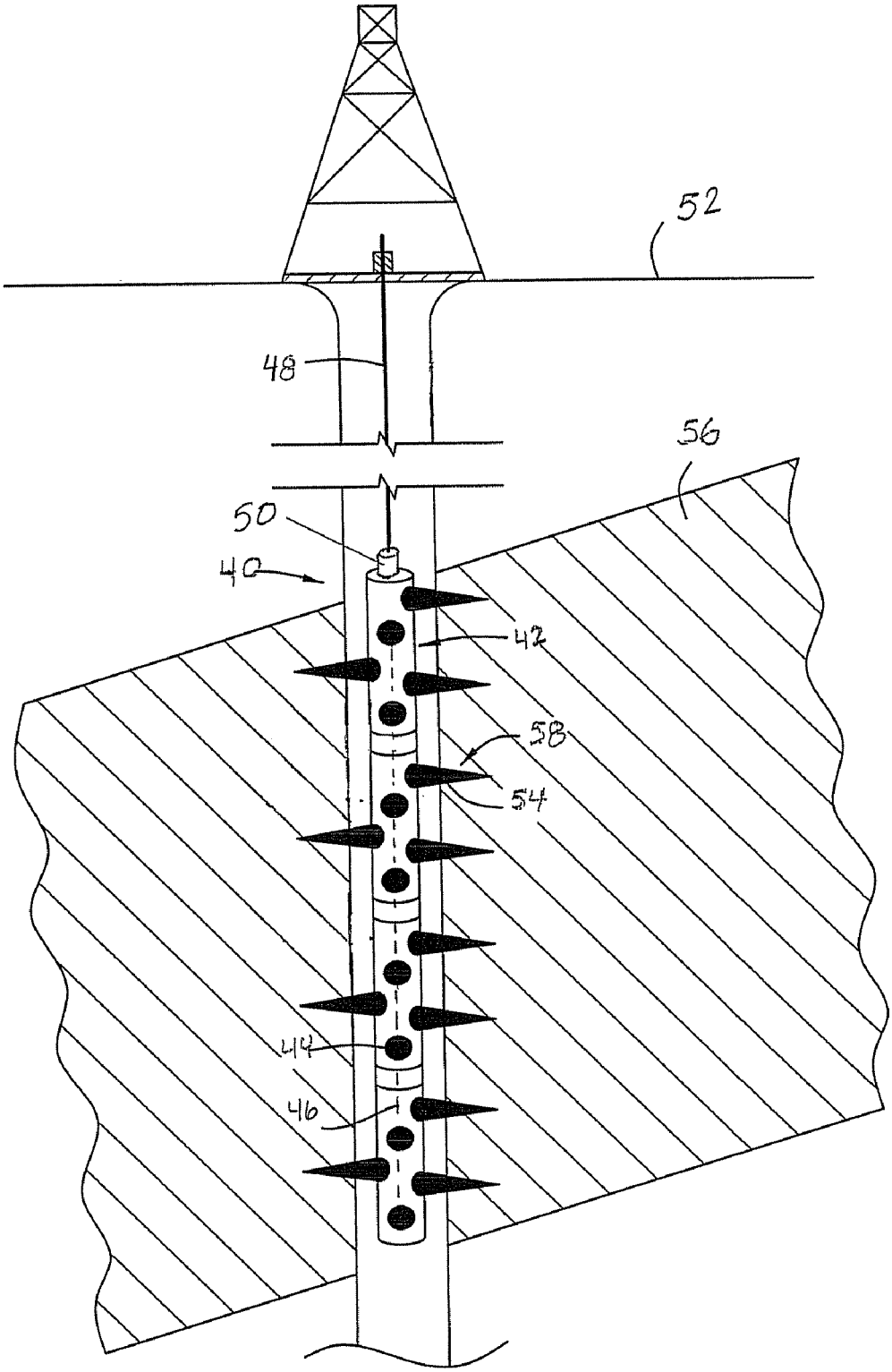
FIG. 4 is a side partial sectional view of a perforating system in a wellbore.

As shown in a cut-away view in FIG. 2, the impedance barrier can comprise a groove 11 formed on the outer surface of the shaped charge holder 12. The groove 11 can be etched, cut, or forged into the holder 12. The cross sectional contour of the impedance barrier 10 is not limited to the rectangular shape as shown in FIG. 2, but can have other profiles such "U"-shaped, triangular, or oval. The barrier 10 however should comprise some form of discontinuity of material for terminating and/or absorbing any energy waves that might be transmitted along the length of the charge holder 12. Moreover, the barrier need not be open at the outer surface of the holder 12, but instead can be a void formed within the body of the holder 12 beneath its surface. As shown in FIG. 2A attenuating type materials 1 can be included within the groove 11A to form the impedance barrier 10A of the holder 12A. The materials 1 can be wood, cork, rubber, cotton, wool, plastic, polymeric materials, foam, other shock absorbing materials, or combinations thereof.

Figure 3:
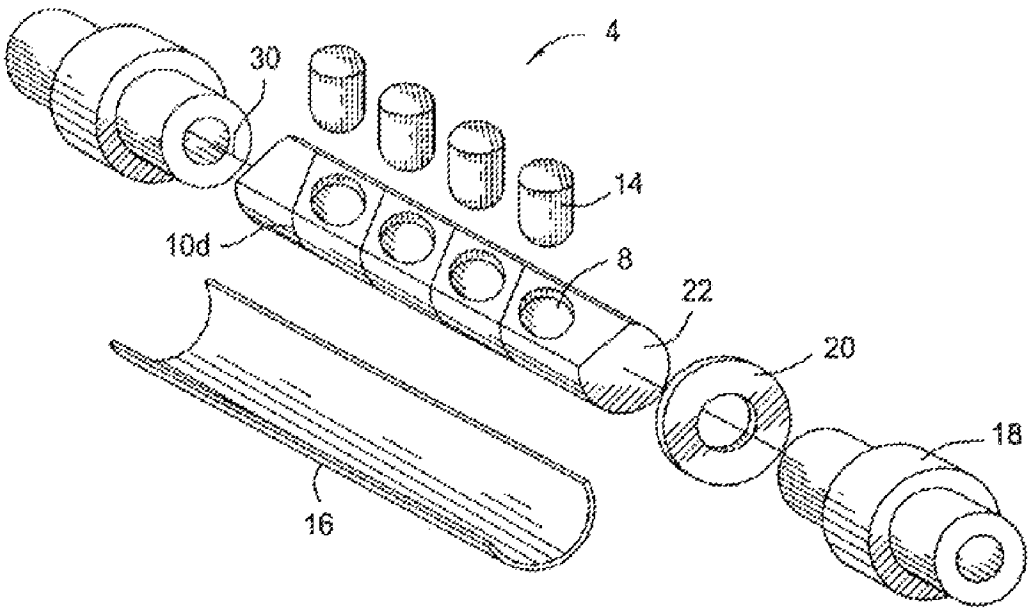
FIG. 3 is a perspective exploded view of one embodiment of a perforating system in accordance with the present invention.

FIG. 3 depicts a perspective exploded view of an embodiment of a perforating device 4 comprising ends 18, a charge carrier 22, a washer 20, shaped charges 14, and an optional orienting weight 16. The charge carrier 22 is used for holding and retaining the associated shaped charges 14 prior to and during detonation of the shaped charges 14. Similar to the shaped charge holders 12 of FIGS. 1*a*-1*d*, the charge carrier 22 includes bores 8 formed therein perpendicular to the axis 30 of the charge carrier 22. The bores 8 extend through the charge carrier 22, where the inner peripheries of the bores 8 are profiled to match the profile of the outer periphery of the shaped charges 14. Accordingly each bore 8 engagingly receives a shaped charge 14 within its inner periphery and retains the shaped charge 14 therein prior to and during use. While the bores 8 shown are aligned at roughly the same radial location on the charge carrier 22, the bores 8 can be formed at any radial location on the carrier 22. As with many perforating systems, the shaped charges 14 can be positioned within the perforating device 4 to detonate at all radial locations around the charge carrier 22. An embodiment of the impedance barrier 10*d* is shown on the charge carrier 22 between each bore 8. Here the impedance barrier 10*d* is a series of grooves cut or formed perpendicular to the axis 30 of the charge carrier 22.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the invention described herein is applicable to any shaped charge phasing as well as any density of shaped charge. Moreover, the invention can be utilized with any size of perforating gun. These and other similar modifications will readily suggest themselves to those skilled in the art, and are intended to be encompassed within the spirit of the present invention disclosed herein and the scope of the appended claims.

What is claimed is:

1. A perforating system comprising:

a single piece gun body;

shaped charges provided in bores formed on the gun body; and a continuous groove formed on the outer surface of the gun body and disposed between each adjacent bore.

2. The perforating system of claim 1, wherein the groove comprises an impedance barrier so that when energy waves are transmitted along the gun body they are absorbed in the impedance barrier.

3. The perforating system of claim 1, further comprising an impedance material disposed in said groove.

4. The perforating system of claim 3, wherein said impedance material is selected from the group consisting of wood, cork, rubber, cotton, plastic, polymeric materials, wool, foam, other shock absorbing materials, and combinations thereof.

5. The perforating system of claim 1, wherein the outer surface of the gun body between the grooves and the bores is substantially smooth and continuous.

6. The perforating system of claim 1, wherein said grooves form a spiral pattern interconnected with axial grooves.

7. The perforating system of claim 1, wherein said groove comprises a spiral pattern formed on the gun body.

8. The perforating system of claim 1 further comprising a firing head, detonating cord, and an actuating member.

9. The perforating system of claim 8, wherein said actuating member is selected from the group consisting of a wireline conveyance member and a tubing conveyance member.

10. A perforating system for use in oil and gas production comprising:

a unibody gun tube;

bores formed on the gun tube;

shaped charges disposed in each said bore; and a groove formed on the gun tube that extends between each adjacent bore, wherein said groove attenuates the shock wave imparted during detonation of each said shaped charge and prevents the shock wave produced by one shaped charge from affecting the performance of other shaped charges.

11. The perforating system of claim 10, wherein the groove comprises an impedance barrier so that when energy waves are transmitted along the gun tube they are absorbed in the impedance barrier.

12. The perforating system of claim 10, further comprising an impedance material disposed in said groove.

13. The perforating system of claim 12, wherein said impedance material is selected from the group consisting of wood, cork, rubber, cotton, plastic, polymeric materials, wool, foam, other shock absorbing materials, and combinations thereof.

14. The perforating system of claim 10, wherein said groove comprises a spiral pattern formed on said shaped charge holder.

15. The perforating system of claim 10 further comprising a firing head, detonating cord, and an actuating member.

16. The perforating system of claim 15, wherein said actuating member is selected from the group consisting of a wireline conveyance member and a tubing conveyance member.

17. A method of perforating comprising:

providing a perforating gun having a single body shaped charge carrier, bores in the shaped charge carrier, and shaped charges in the bores;

forming a continuous groove on the surface of the shaped charge holder between each adjacent bore by removing material from the outer surface of the shaped charge holder;

lowering the perforating gun into a wellbore; and initiating perforating gun detonation.

18. The method of claim 17, further comprising inserting an attenuation material within the groove.

* * * * *